US005196292A

United States Patent [19]

Machonkin et al.

[11] Patent Number: 5,196,292

[45] Date of Patent: * Mar. 23, 1993

[54] NUCLEATED HIGH CONTRAST PHOTOGRAPHIC ELEMENTS CONTAINING BALLASTED THIOETHER ISOTHIOUREAS TO INHIBIT PEPPER FOG AND RESTRAIN IMAGE SPREAD

[75] Inventors: Harold I. Machonkin, Webster; Donald L. Kerr, Rochester, both of N.Y.

[73] Assignee: Eastman Kodak Company, Rochester, N.Y.

[ * ] Notice: The portion of the term of this patent subsequent to Jun. 30, 2009 has been disclaimed.

[21] Appl. No.: 778,037

[22] Filed: Oct. 17, 1991

[51] Int. Cl.[5] ..... G03C 1/34; G03C 1/42

[52] U.S. Cl. ..... 430/264; 430/598; 430/611

[58] Field of Search ..... 430/264, 611, 598

[56] References Cited

U.S. PATENT DOCUMENTS

| | | | |
|---|---|---|---|
| 3,220,839 | 3/1965 | Herz et al. | 430/611 |
| 4,221,857 | 7/1980 | Okutsu et al. | 430/264 |
| 4,272,606 | 9/1981 | Mifune et al. | 430/264 |
| 4,975,354 | 3/1990 | Machonkin et al. | 430/264 |
| 5,126,227 | 6/1992 | Machonkin et al. | 430/264 |

FOREIGN PATENT DOCUMENTS

| | | |
|---|---|---|
| 0226184 | 10/1987 | European Pat. Off. . |
| 0356801 | 12/1990 | European Pat. Off. . |

*Primary Examiner*—Richard L. Schilling
*Attorney, Agent, or Firm*—Alfred P. Lorenzo

[57] ABSTRACT

Silver halide photographic elements which are capable of high contrast development and are especially useful in the field of graphic arts have incorporated therein a hydrazine compound which functions as a nucleator, an amino compound which functions as an incorporated booster, and a ballasted thioether isothiourea which functions to inhibit pepper fog and restrain image spread.

20 Claims, No Drawings

NUCLEATED HIGH CONTRAST PHOTOGRAPHIC ELEMENTS CONTAINING BALLASTED THIOETHER ISOTHIOUREAS TO INHIBIT PEPPER FOG AND RESTRAIN IMAGE SPREAD

FIELD OF THE INVENTION

This invention relates in general to photography and in particular to novel black-and-white photographic elements More specifically, this invention relates to novel nucleated silver halide photographic elements which are capable of high contrast development and are especially useful in the field of graphic arts.

BACKGROUND OF THE INVENTION

U.S. Pat. No. 4,975,354 issued Dec. 4, 1990, entitled "Photographic Element Comprising An Ethyleneoxy-Substituted Amino Compound And Process Adapted To Provide High Contrast Development", by Harold I Machonkin and Donald L. Kerr, describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers.

While the invention of U.S. Pat. No. 4,975,354 represents a very important advance in the art, improvement in the photographic elements described therein, particularly with regard to pepper fog and image spread characteristics, is needed.

A photographic system depending on the conjoint action of hydrazine compounds which function as nucleators and amino compounds which function as boosters is an exceedingly complex system. It is influenced by both the composition and concentration of the nucleator and the booster and by many other factors including the pH and composition of the developer and the time and temperature of development. The goals of such a system include the provision of enhanced speed and contrast, together with excellent dot quality and low pepper fog.

The goal of achieving low pepper fog is one which is exceptionally difficult to achieve without sacrificing other desired properties such as speed and contrast. (The term "pepper fog" is commonly utilized in the photographic art, and refers to fog of a type characterized by numerous fine black specks). A particularly important film property is "discrimination", a term which is used to describe the ratio of the extent of shoulder development to pepper fog level. Good discrimination, i.e., full shoulder development with low pepper fog, is necessary to obtain good halftone dot quality.

Image spread in photographic elements of the type described in U.S. Pat. No. 4,975,354 involves infectious imagewise development of unexposed photographic silver halide grains in close proximity to exposed photographic silver halide grains. Like pepper fog, image spread is a detrimental nucleation effect, and means for controlling both pepper fog and image spread are critically needed to improve the performance of these photographic elements.

Herz et al, U.S. Pat. No. 3,220,839 issued Nov. 30, 1965, describes the incorporation of certain isothioureas in photographic emulsions to prevent incubation fog. The photographic elements utilizing these emulsions do not contain a hydrazine compound that functions as a nucleating agent nor an incorporated booster and are not subject to pepper fog.

Okutsu et al, U.S. Pat. No. 4,221,857 issued Sep. 9, 1980, describes a high contrast silver halide photographic element containing a hydrazine compound that functions as a nucleator and a polyalkylene oxide compound which serves to minimize formation of drag streaks upon development. The photographic element does not contain an amino compound that functions as an incorporated booster.

Mifune et al, U.S. Pat. No. 4,272,606 issued Jun. 9, 1981, describes a high contrast silver halide photographic element containing a contrast enhancing arylhydrazide and, as an agent which increases sensitivity and contrast, a compound having a thioamido moiety in the molecule thereof The photographic element does not contain an amino compound that functions as an incorporated booster.

European Patent Application No. 0226184 published Jun. 24, 1987 is concerned primarily with pepper-fog-reducing and image-spread-restraining compounds intended to be incorporated in a developing solution and describes the use of certain isothiourea compounds and certain free mercapto-compounds for this purpose. The photographic elements described do not contain an amino compound that functions as an incorporated booster, but an amino compound is preferably incorporated in the developing solution. While incorporation of the isothiourea compounds and free mercapto-compounds in the photographic element is also disclosed, there is no teaching relating to use of these compounds in a photographic element that contains an incorporated booster. Moreover, the isothiourea compounds described are characterized by features such as the presence of solubilizing groups, which adapt them for most effective use in a developing solution and make them unsuitable for incorporation in a photographic element.

Copending commonly assigned U.S. patent application Ser. No. 599,218 filed Oct. 17, 1990 and issued Jun. 30, 1992, as U.S. Pat. No. 5,126,227, "Hign Contrast Photographic Elements Containing Ballasted Hydrophobic Isothioureas", by Harold I. Machonkin and Donald L. Kerr describes hydrophobic isothiourea compounds comprising a ballasting group, attached to the sulfur atom, which serves to restrict the mobility of the compound and thereby aid in retaining it in the photographic element during development. When incorporated in a silver halide photographic element containing both a hydrazine compound that functiions as a nucleator and an amino compound that functions as a booster, the ballasted hydrophobic isothiourea compound is highly effective in reducing pepper fog and also serves to restrain image spread. However, the ballasted hydrophobic isothiourea compounds exhibit certain shortcomings which have hindered their commercial utilization. Thus, for example, the performance of these compounds is significantly affected by the type of silver halide grains employed, i.e., they don't function equally well with all of the different types of silver halides that are useful in high contrast photographic elements employed in the field of graphic arts. The ballasted hydrophobic isothiourea compounds are believed to release a free mercaptan, which is the active species, during the development step. The free mercaptan then binds to the silver. Because the active species is released by an hydrolysis step, the action of the ballasted hydrophobic isothiourea compounds is very strongly affected by the composition and pH of the developer, so that the choice of developer may be unduly restricted.

Copending commonly assigned U.S. patent application Ser. No. 735,975 filed Jul. 25, 1991, "Nucleated High Contrast Photographic Elements Containing Thioether Compounds To Inhibit Pepper Fog And Restrain Image Spread", by Harold I Machonkin and Donald L. Kerr describes high contrast photographic elements having incorporated therein a hydrazine compound which functions as a nucleator, an amino compound which functions as an incorporated booster and a thioether compound which is free of both hydrazino and amino functionality and which (1) contains within its structure at least one thio (-S-) group, (2) contains within its structure a group comprised of at least three repeating ethyleneoxy units, and (3) has a partition coefficient (as defined in the aforesaid patent application Ser. No. 735,975) of at least one. While these thioether compounds are highly effective, still further improvement in inhibition of pepper fog and restraint of image spread is desired.

The present invention is directed toward the objective of providing novel high contrast silver halide photographic elements which exhibit improved characteristics in regard to control of pepper fog and restraint of image spread, while still retaining excellent characteristics with respect to speed, contrast and full shoulder development.

SUMMARY OF THE INVENTION

The present invention provides novel silver halide photographic elements which are adapted to form a high contrast image when development is carried out with an aqueous alkaline developing solution. The novel photographic elements have incorporated therein a hydrazine compound which functions as a nucleator, an amino compound which functions as an incorporated booster, and a ballasted thioether isothiourea which functions to inhibit pepper fog and restrain image spread. The ballasted thioether isothioureas which are useful in this invention are compounds of the formula:

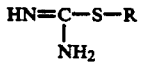

wherein R is a monovalent thioether group of such size and configuration as to confer on the isothiourea sufficient bulk as to render it substantially non-diffusible from the layer in which it is coated in a photographic element.

Since the novel photographic elements of this invention have incorporated therein the hydrazine compound which functions as a nucleator, the amino compound which functions as a booster, and the ballasted thioether isothiourea which functions to inhibit pepper fog and restrain image spread, they are not dependent on the use of additives in the developing solution for any of these vital functions and can, accordingly, be processed with conventional, low cost, rapid access developers that are widely used in the field of graphic arts.

DESCRIPTION OF THE PREFERRED EMBODIMENTS

Any hydrazine compound that functions as a nucleator, is capable of being incorporated in the photographic element, and is capable of acting conjointly with the incorporated booster to provide high contrast, can be used in the practice of this invention. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayres and overcoating layers.

An especially preferred class of hydrazine compounds for use in the elements of this invention are the hydrazine compounds described in Machonkin et al, U.S. Pat. No. 4,912,016 issued Mar. 27, 1990. These compounds are aryl hydrazides of the formula:

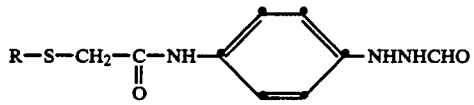

where R is an alkyl or oycloalkyl group.

Another especially preferred class of hydrazine compounds for use in the elements of this invention are the hydrazine compounds described in copending commonly assigned U.S. patent application Ser. No. 167,814, "High Contrast Photographic Element and Emulsion And Process For Their Use", by J. J. Looker, R. E. Leone and L. J. Fleckenstein, filed Mar. 14, 1988 and issued Apr. 14, 1992, as U.S. Pat. No. 5,104,769. The disclosure of this application is incorporated herein by reference in its entirety.

The hydrazine compounds described in the aforesaid patent application Ser. No. 167,814 have one of the following structural formulae:

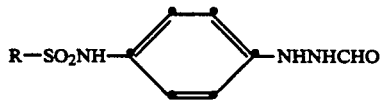

I or

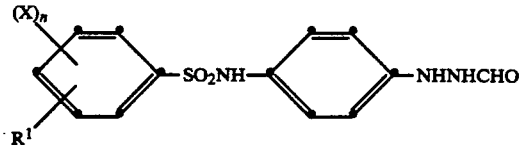

II

Wherein:

R is alkyl having from 6 to 18 carbon atoms or a heterocyclic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or —NHCOR², —NHSO₂R², —CONR²R³ or —SO₂NR²R³ where R² and R³, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or —NHCOR² or —NHSO₂R² where R² is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by R¹ can be straight or branched chain and can be substituted or unsubstituted. Substituents on these groups can be alkoxy having from 1 to about 4 carbon atoms, halogen atoms (e.g. chlorine or fluorine); or —NHCOR²—or —NHSO₂R² where R² is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

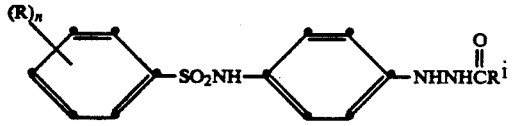

II where each R is a monovalent group comprised of at least three repeating ethyleneoxy units, n is 1 to 3, and R¹ is hydrogen or a blocking group.

These hydrazides are described in Machonkin and Kerr, U.S. Pat. No. 5,041,355, issued Aug. 20, 1991.

Still another especially preferred class of hydrazine compounds are the compounds described in Machonkin and Kerr, U.S. Pat. No. 4,988,604 issued Jan. 29, 1991. These compounds are aryl sulfonamidophenyl hydrazides containing both thio and ethyleneoxy groups which have the formula:

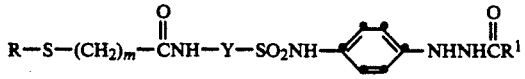

where R is a monovalent group comprised of at least three repeating ethyleneoxy units, m is 1 to 6, Y is a divalent aromatic radical, and R¹ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

A still further especially preferred class of hydrazine compounds are the compounds described in Looker and Kerr, U.S. Pat. No. 4,994,365, issued Feb. 19, 1991. These compounds are aryl sulfonamidophenyl hydrazides containing an alkyl pyridinium group which have the formula:

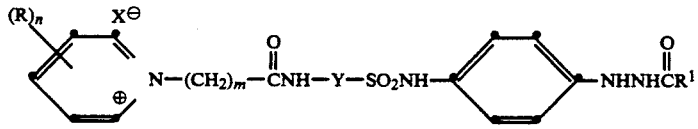

where each R is an alkyl group, preferably containing 1 to 12 carbon atoms, n is 1 to 3, X is an anion such as chloride or bromide, m is 1 to 6, Y is a divalent aromatic radical, and R¹ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by R¹ can be, for example:

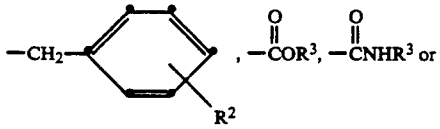

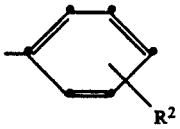

where R² is hydroxy or a hydroxy-substituted alkyl group having from 1 to 4 carbon atoms and R³ is an alkyl group having from 1 to 4 carbon atoms.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016, 4,914,003, 4,975,354, 4,988,604, 4,994,365, and 5,041,355.

The hydrazine compound utilized as a nucleator in this invention is usually employed in an amount of from about 0.005 millimoles to about 100 millimoles per mole of silver and more typically from about 0.1 millimoles to about 10 millimoles per mole of silver.

The hydrazine compounds are employed in this invention in combination with negative-working photographic emulsions comprised of radiation-sensitive silver halide grains capable of forming a surface latent image and a binder. Useful silver halides include silver chloride, silver chlorobromide, silver chlorobromoiodide, silver bromide and silver bromoiodide.

Silver halide grains suitable for use in the emulsions of this invention are capable of forming a surface latent image, as opposed to being of the internal latent image-forming type. Surface latent image silver halide grains are employed in the majority of negative-working silver halide emulsions, whereas internal latent image-forming silver halide grains, while capable of forming a negative image when developed in an internal developer, are usually employed with surface developers to form direct-positive images. The distinction between surface latent image and internal latent image silver halide grains is generally well recognized in the art.

The silver halide grains, when the emulsions are used for lith applications, have a mean grain size of not larger than about 0.7 micron, preferably about 0.4 micron or less. Mean grain size is well understood by those skilled in the art, and is illustrated by Mees and James, *The Theory of the photographic Process*, 3rd Ed., MacMillan 1966, Chapter 1, pp. 36–43. The photographic emulsions can be coated to provide emulsion layers in the photographic elements of any conventional silver coverage Conventional silver coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the mean grain size.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more, it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin) gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like In addition to hydrophilic colloids, the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialylaminoalkyl acrylates, vinyl imidazole copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, December 1971, Item 9232, which disclosure is hereby incorporated by reference.

Emulsions according to this invention having silver halide grains of any conventional geometric form (e.g. regular cubic or octahedral crystalline form) can be prepared by a variety of techniques, e.g., single-jet, double-jet (including continuous removal techniques), accelerated flow rate and interrupted precipitation techniques, as illustrated by Trivelli and Smith, *the Photographic Journal*, Vol. LXXIX, May, 1939, pp. 330–338, T. H. James, *The Theory of the Photographic Process*, 4th Ed., MacMillan, 1977, Chapter 3; Terwilliger et al Research Disclosure, Vol. 149, September 1976, Item 14987, as well as U.S. Patent Nos. 2,222,264; 3,650,757; 3,672,900; 3,917,485; 3,790,387; 3,761,276 and 3,979,213, and German OLS No. 2,107,118 and U. K. Patent Publications 335,925, 1,430,465 and 1,469,480, which publications are incorporated herein by reference.

It is particularly preferred that the silver halide grains are doped to provide high contrast. As is known in the art, use of a suitable doping agent, in concert with the use of a hydrazine compound that functions as a nucleator, is capable of providing an extremely high contrast response. Doping agents are typically added during the crystal growth stages of emulsion preparation, for example, during initial precipitation and/or physical ripening of the silver halide grains. Rhodium is a particularly effective doping agent, and can be incorporated in the grains by use of suitable salts such as rhodium trichloride. Rhodium-doping of the silver halide grains employed in this invention is especially beneficial in facilitating the use of chemical sensitizing agents without encountering undesirably high levels of pepper fog. Doping agents described in McDugle et al, U.S. Pat. No. 4,933,272 as being useful in graphic arts emulsions, can also be advantageously employed. These are hexacoordinated complexes of the formula:

$$[M'(NO)(L')_5]^m$$

wherein m is zero, −1, −2, or −3.

M' represents chromium, rhenium, ruthenium, osmium or iridium, and L' represents one or a combination of halide and cyanide ligands or a combination of these ligands with up to two aquo ligands.

The silver halide emulsions can be chemically sensitized with active gelatin, as illustrated by T. H. James, *the Theory of the photographic Process.* 4th Ed., MacMillan, 1977, pp. 67–76, or with sulfur, selenium, tellurium, platinum, gold, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 134, June 1975, Item 13452. The emulsions need not be chemically sensitized, however, in order to exhibit the advantages of this invention.

The silver halide emulsions can be spectrally sensitized with dyes from a variety of classes, including the polymethine dye class, which includes the cyanines, merocyanines, complex cyanines and merocyanines, (i.e., tri-, tetra- and polynuclear cyanines and merocyanines), oxonols, hemioxonols, styryls, merostyryls and streptocyanines.

A particularly preferred method of achieving chemical sensitization is by use of a combination of a gold compound and a urea compound as described in copending commonly assigned U.S. patent application Ser. No. 735,979, filed Jul. 25, 1991, entitled "Nucleated High Contrast Photographic Elements Containing Urea Compounds Which Enhance Speed And Increase Contrast", by Anthony Adin. This method provides exceptional results when used with high-chloride silver halide emulsions, i.e., those in which at least the surface portion of the silver halide grains is composed of more than 50 mole percent silver chloride. The combination of the gold compound and urea compound functions to enhance speed and increase contrast in the toe region of the sensitometric curve, without a concurrent increase in fog. Urea compounds effective for this purpose are 1,1,3,3-tetra-substituted middle chalcogen urea compounds in which at least one substituent comprises a nucleophilic center. A combination of potassium tetrachloroaurate and 1,3- dicarboxymethyl-1,3-dimethyl-2-thiourea is especially effective.

Chemical sensitization can also be provided by use of a combination of a gold compound and a thiourea having one to three alkyl or acyl substituents as described in copending commonly assigned U.S. Patent Application Ser. No. 778,028, filed Oct. 17, 1991, "Nucleated High Contrast Photographic Elements Containing Substituted Thioureas Which Enhance Speed And Increase Contrast", by Anthony Adin.

The photographic system to which this invention pertains is one which employs a hydrazine compound as a nucleating agent and an amino compound as an incorporated booster. Amino compounds which are particularly effective as incorporated boosters are described in Machonkin and Kerr, U.S. Pat. No. 4,975,354, issued Dec. 4, 1990.

The amino compounds useful as incorporated boosters described in U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient (as hereinafter defined) of at least one, preferably at least three, and most preferably at least four.

Included within the scope of the amino compounds utilized in this invention as incorporated boosters are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as incorporated boosters are compounds of at least 20 carbon atoms.

Preferred amino compounds for use as incorporated boosters are bis-tertiary-amines which have a partition coefficient of at least three and a structure represented by the formula:

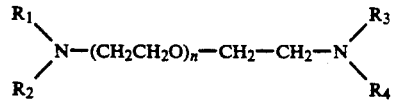

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as incorporated boosters are bis-secondary amines which have a partition coefficient of at least three and a structure represented by the formula

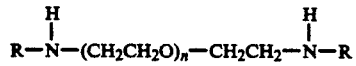

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The most preferred amino compound for use in this invention as an incorporated booster is a compound of the formula:

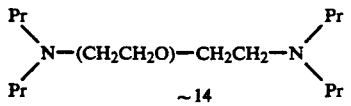

~14 where Pr represents n-propyl.

Other amino compounds useful as incorporated boosters are described in Yagihara et al, U.S. Pat. No. 4,914,003 issued Apr. 3, 1990. The amino compounds described in this patent are represented by the formula:

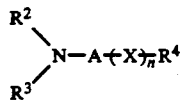

herein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents —$CONR^5$—, —O—$CONR^5$, —$NR^5CONR^5$,—$NR^5COO$—, —COO—, —OCO—, —CO—, —$NR^5CO$—, —$SO_2NR^5$—, —$NR^5SO_2$—, —$SO_2$—, —S—or —O—group in which $R^5$ represents a hydrogen atom or a lower alkyl group and n represents 0 or 1, with the proviso that the total number of carbon atoms contained in $R^2$, $R^3$, $R^4$ and A is 20 or more.

The amino compound utilized as an incorporated booster is typically employed in an amount of from about 0.1 to about 25 millimoles per mole of silver, and more preferably in an amount of from about 0.5 to about 15 millimoles per mole of silver.

As hereinabove described, the present invention is based on the discovery that ballasted thioether isothioureas of the formula:

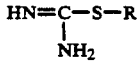

wherein R is a monovalent thioether group, are effective in inhibiting pepper fog and restraining image spread in a high contrast photographic system that employs a hydrazine compound as a nucleator and an amino compound as an incorporated booster.

The ballasting group represented by the symbol "R" in the above formula is a thioether group, i.e., it includes within its structure at least one

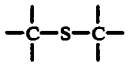

group, and is of such size and configuration as to confer on the isothiourea sufficient bulk as to render it substantially non-diffusible from the layer in which it is coated in a photographic element.

While applicants do not wish to be bound by any theoretical explanation for the manner in which their invention functions, it is believed that the ballasted thioether isothiourea releases a free mercaptan in the photographic element during development and that the mercaptan binds to the silver. Isothiourea compounds are pH sensitive and the rate at which the mercaptan is released increases with increasing pH of the developing solution. Use of either too high a pH or too great a concentration of the isothiourea compound is undesirable. While it will inhibit pepper fog, there will be an accompanying undesirable decrease in speed and/or upper scale contrast.

In this invention, the concentrations of nucleator and booster employed can be varied to control speed, contrast, and to some degree, the shoulder density. However, increases in speed and contrast generally are accompanied by increased levels of pepper fog. Image spread is an additional undesirable consequence of the autocatalytic nucleation process. Development within an area of exposure, such as a halftone dot or a line, triggers nucleation at the dot or line edge to cause the dot or line to increase in size. The nucleated development outside the original exposed area, in turn, triggers further nucleation and the growth process continues with time of development at essentially a constant rate. Thus, an optimized photographic system requires control of both pepper fog and image spread, and such control is provided in a very effective manner by use of the ballasted thioether isothioureas described herein.

Preferably, the ballasted thioether isothioureas utilized in this invention are compounds of the formula:

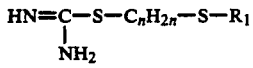

wherein $R_1$ is an alkyl group; a cycloalkyl group, an amino group; a dialkylamino group, an aryl group such as phenyl or naphthyl; an alkaryl group such as tolyl; an aralkyl group such as benzyl or phenethyl; or a heterocyclic group such as thiazole, thiadiazole, triazole, tetrazole, oxazole, oxadiazole, oxathiazole, diazole, benzopyrazole, benzoxazole, benzothiazole and benzotriazole; and n is an integer with a value of from 1 to 12. The alkyl, cycloalkyl, amino, aryl, alkaryl, aralkyl and heterocyclic groups can be unsubstituted or substituted with substituents such as halo, alkoxy, haloalkyl, sulfo, carboxy, alkoxyalkyl, alkoxycarbonyl, acyl, aryloxy, alkylcarbonamido and alkylsulfonamido.

Typical specific examples of ballasted thioether isothioureas useful in this invention include the following:

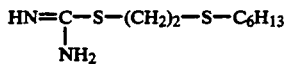

I

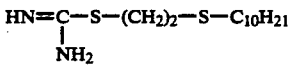

II

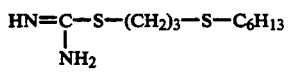

III

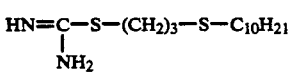

IV

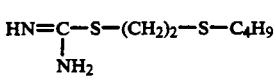

V

-continued

VI

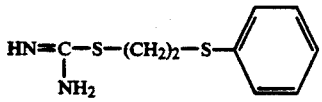

VII

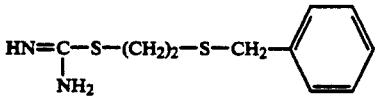

VIII

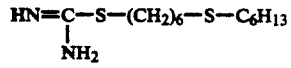

IX

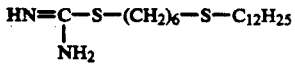

X

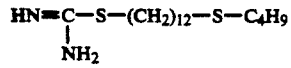

XI

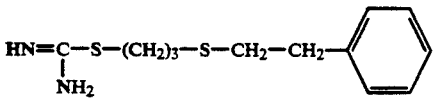

XII

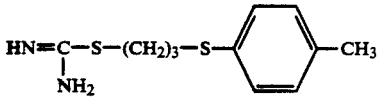

XIII

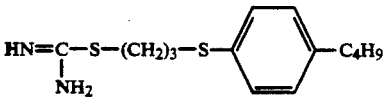

XIV

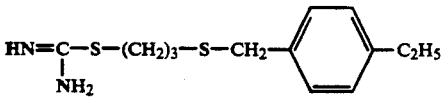

XV

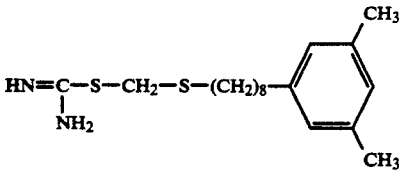

XVI

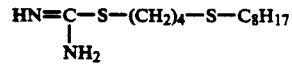

XVII

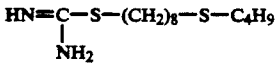

XVIII

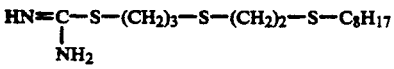

XIX

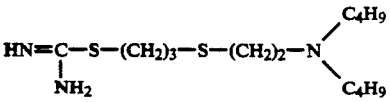

-continued

XX

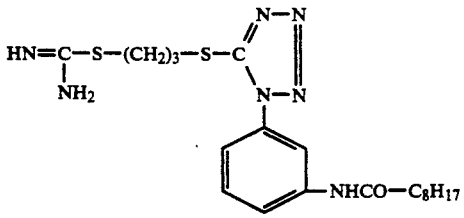

The ballasted thioether isothiourea utilized herein is typically employed in an amount of from about 0.1 to about 25 millimoles per mole of silver, and more preferably in an amount of from about 0.2 to about 5 millimoles per mole of silver. The ballasted thioether isothiourea can be employed as the free base or as a suitable salt such as the hydrochloride or hydrobromide salt. It preferably has a partition coefficient (as herein defined) of at least one and more preferably of at least three.

Particularly preferred sensitizing dyes for use in this invention are the benzimidazolocarbocyanine dyes described in copending commonly assigned U.S. patent application Ser. No. 735,484, filed Jul. 25, 1991, "Nucleated High Contrast Photographic Elements Containing Low-Stain Sensitizing Dyes", by Anthony Adin, Linda J. Knapp, and Steven G. Link. These dyes provide enhanced photographic sensitivity, yet leave substantially no sensitizing dye stain after rapid access processing.

The benzimidazolocarbocyanine sensitizing dyes described in the aforesaid patent application are benzimidazolocarbocyanine sensitizing dyes having at least one acid-substituted alkyl group attached to a nitrogen atom of a benzimidazole ring. Preferred examples of such dyes are those of the formula:

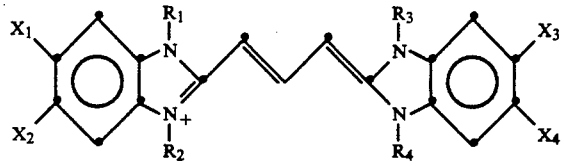

wherein $X_1$, $X_2$, $X_3$ and $X_4$ are, independently, hydrogen, cyano, alkyl, halo, haloalkyl, alkylthio, alkoxycarbonyl, aryl, carbamoyl or substituted carbamoyl, $R_1$ and $R_3$ are alkyl, and $R_2$ and $R_4$ are, independently, alkyl, alkenyl, substituted alkyl or substituted alkenyl with the proviso that at least one of R2 and R4 is acid-substituted alkyl and with the further proviso that when both $R_2$ and $R_4$ are acid-substituted alkyl, there is also a cation present to balance the charge.

The term "partition coefficient", as used herein, refers to the log P value of the compound with respect to the system n-octanol/water as defined by the equation:

$$\log P = \log \frac{[X]_{octanol}}{[X]_{water}}$$

where X = concentration of the compound. The partition coefficient is a measure of the ability of a compound to partition between aqueous and organic phases and is calculated in the manner described in an article by A. Leo, P.Y.C. Jow, C. Silipo and C. Hansch, Journal of Medicinal Chemistry, Vol. 18, No. 9, pp. 865–868, 1975. Calculations for log P can be carried out using MedChem software, version 3.54, Pomona College, Claremont, Calif. The higher the value of log P, the more hydrophobic the compound. Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media, and a compound with a log P of two is one hundred times more soluble in organic media than in aqueous media.

The invention is further illustrated by the following examples of its practice.

EXAMPLES 1-7

Each coating used in obtaining the data provided in these examples was prepared on a polyester support, using a monodispersed 0.23 micrometer cubic, rhodium-doped, sulfur plus gold sensitized AgClBr(70/30) emulsion at 3.24 g/m$^2$ Ag, 2.35 g gel/m$^2$ and 1.00 g latex/m$^2$, where the latex is a copolymer of methyl acrylate, 2-acrylamido-2-methylpropane sulfonic acid and 2-acetoacetoxyethylmethacrylate. Sulfur and gold sensitization was provided by addition of 1.5 mg/Ag mole of 1,3-dicarboxymethyl-1,3-dimethyl-2-thiourea and 1.1 mg/Ag mole of potassium tetrachloroaurate. The silver halide emulsion also contained, in amounts of 50, 400, and 200 mg/Ag mole, respectively, the antifoggants 1-(3-acetamidophenyl)-5-mercaptotetrazole, 5-carboxy-4-hydroxy-6-methyl-2-methyl-mercapto1,3,3a,7-tetraazaindene and 5-bromo-4-hydroxy-6-methyl-1,3,3a,7-tetraazaindene. The emulsion was spectr sensitized at 208 mg/Ag mol with a sensitizing dye of the formula:

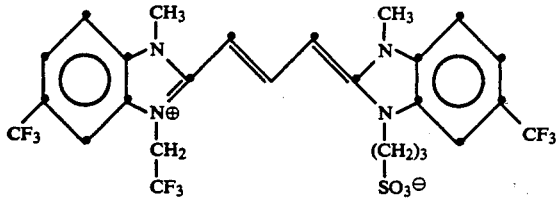

and the emulsion layer was overcoated with gelatin containing polymethylmethacrylate beads. The nucleating agent was added as a methanol solution to the emulsion melts at a level of 0.2 millimoles (mM) per mole of silver. The compound employed as the nucleating agent is represented by the formula:

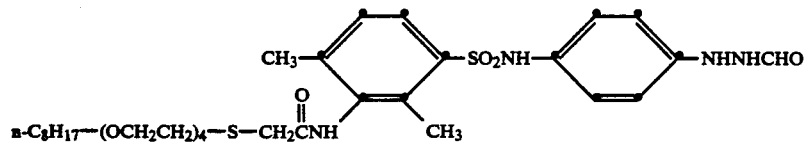

An "incorporated booster" was added as a methanol solution in an amount of 2 g/Ag mol. The compound employed as the "incorporated booster" is represented by the formula:

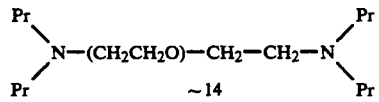

where Pr represents n-propyl

Ballasted thioether isothioureas I to VII were incorporated n the emulsion at 0.5 mmol/Ag mol as methanol solutions. Coatings were exposed through a 0.1 Log E step tablet for five seconds to a 3000° K. tungsten light source and processed for 30 seconds at 30° C. in the developer solution. Processing was carried out in a KODAK KODAMATIC Model 42S processor.

To prepare the developer solution, a concentrate was prepared from the following ingredients:

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 75 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 56 g |
| Boric acid | 6.9 g |
| Diethylene glycol | 110 g |
| 47% Potassium Carbonate | 120 g |
| Water to one liter | |

The concentrate was diluted at a ratio of one part of concentrate to three parts of water to produce a working strength developing solution with a pH of 10.5.

An electronic image analyzer was used to scan processed unexposed samples and count the number of pepper fog spots (>10 micrometer diameter) contained in an area of 600 square millimeters. Standard sensitometry exposures were processed and analyzed to monitor speed and shoulder density effects.

Sensitometry parameters are expressed in Table I in terms of the change produced by incorporation of the ballasted thioether isothiourea versus the control which contained no isothiourea compound and was processed under identical conditions. Values are reported for speed, practical density point (PDP, a measure of shoulder development) and pepper fog (PF). Therefore, the changes in speed, practical density point and pepper fog produced by the ballasted thioether isothiourea are directly recorded in the table. By definition, the delta log speed, delta PDP and delta log PF for the control are zero.

In each of examples 1 to 7, the ballasted thioether isothiourea was employed in the form of the hydrochloride salt. Comparative test A utilized the hydrobromide salt of isothiourea compound "A" of the formula:

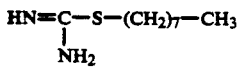

Comparative test B utilized the hydrobromide salt of isothiourea compound "B" of the formula:

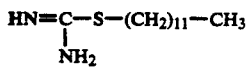

Both compounds A and B were utilized at a concentration of 0.5 mmol/Ag mol.

Each of the coatings was also analyzed for the effect upon image spread of the incorporation of the isothiourea compound.

Image spread measurements were performed by following the growth in diameter of halftone dots with development time. The films were contact exposed to a 52 line/cm 90% tint to produce a 10% exposed dot pattern. The films were then developed in a device that measures the infrared (IR) density during development. The integrated IR halftone density of the developing tint pattern was converted to the equivalent dot diameter using the relation between integrated density and percent dot area. The resulting plots of increasing dot diameter with development time were linear (constant dot growth rate) during the first 60 to 90 seconds of development. The slope of the linear dot diameter versus development response is equal to the dot growth rate reported in Table II below.

TABLE I

| Example No. | Isothiourea | Log P | Delta Log Speed* | Delta PDP** | Delta Log PF*** |
|---|---|---|---|---|---|
| Control | — | — | 0.00 | 0.00 | 0.00 |
| Comparison 1 | A | 3.78 | −0.02 | −0.22 | −0.12 |
| Comparison 2 | B | 5.90 | −0.02 | −0.34 | −0.07 |
| 1 | I | 3.28 | −0.01 | −0.06 | −0.14 |
| 2 | II | 5.40 | −0.03 | −0.14 | −0.46 |
| 3 | III | 3.40 | −0.02 | −0.36 | −0.58 |
| 4 | IV | 5.51 | −0.01 | −0.39 | −0.43 |
| 5 | V | 2.22 | −0.01 | −0.38 | −0.33 |
| 6 | VI | 2.28 | −0.01 | −0.19 | −0.48 |
| 7 | VII | 2.35 | −0.03 | −0.42 | −0.86 |

*DELTA LOG SPEED = LOG $\frac{\text{Control Exposure @ D = 0.6}}{\text{Test Exposure @ D = 0.6}}$

**PDP = Practical Density Point = Density at 0.4 log E Past Speed Point

DELTA PDP = Test PDP − Control PDP

***DELTA LOG PF = LOG $\frac{\text{Number of PF spots in test}}{\text{Number of PF spots in control}}$ (A Delta Log PF of −0.3 represents a reduction in pepper fog of two times, while a Delta Log PF of −1.0 represents a reduction in pepper fog of ten times).

TABLE II

| Example No. | Isothiourea | Log P | Dot Growth Rate (microns/sec) |
|---|---|---|---|
| Control | — | — | 0.63 |
| Comparison 1 | A | 3.78 | 0.62 |
| Comparison 2 | B | 5.90 | 0.62 |
| 1 | I | 3.28 | 0.55 |
| 2 | II | 5.40 | 0.58 |
| 3 | III | 3.40 | 0.54 |
| 4 | IV | 5.51 | 0.58 |
| 5 | V | 2.22 | 0.57 |
| 6 | VI | 2.28 | 0.60 |
| 7 | VII | 2.35 | 0.54 |

As indicated by the data in Table I, each of the ballasted thioether isothioureas employed in examples 1 to 7 brought about a substantial reduction in the level of pepper fog, with compound VII reducing pepper fog by a factor of almost ten times. No significant reduction in photographic speed occurred with any of compounds I to VII. Compounds A and B also reduced pepper fog, but to a much lesser extent. As indicated by the data in Table II, each of compounds I to VII reduced the dot growth rate significantly from the value of 0.63 microns/sec exhibited by the control which contained no isothiourea compound. Compounds A and B were ineffective in reducing dot growth rate in the silver chlorobromide emulsion used in these tests.

Use of ballasted thioether isothioureas in accordance with the teachings of this invention provides many important benefits in the field of graphic arts. These compounds provide a means to control both pepper fog and image spread. They are effective with all the different types of silver halides utilized in high contrast photographic elements for the graphic arts. By using them in combination with hydrazine compounds that function as nucleators and amino compounds that function as incorporated boosters, the resulting photographic system provides high speed, high contrast, low pepper fog, good discrimination, freedom from seasoning effects, good dot quality and minimal chemical spread. These benefits are achieved with the hydrazine compound, the amino compound, and the ballasted thioether isothiourea all being incorporated in the photographic element, so that conventional low cost developing solutions can be employed.

The invention has been described in detail with particular reference to preferred embodiments thereof, but it will be understood that variations and modifications can be effected within the spirit and scope of the invention.

What is claimed is:

1. A silver halide photographic element adapted to form a high contrast image when developed with an aqueous alkaline developing solution; said element comprising:

(1) a hydrazine compound that functions as a nucleator, (2) an amino compound that functions as an incorporated booster, and (3) a ballasted thioether isothiourea that functions as a pepper fog inhibitor and image spread restrainer, said ballasted thioether isothiourea having the formula:

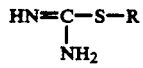

wherein R is a monovalent thioether group of such size and configuration as to confer on the isothiourea sufficient bulk as to render it substantially non-diffusible from the layer of said element in which it is coated.

2. A silver halide photographic element as claimed in claim 1 wherein said hydrazine compound is an aryl sulfonamidophenyl hydrazide of the formula:

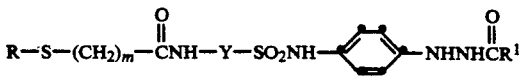

where R is a monovalent group comprised of at least three repeating ethyleneoxy units, m is 1 to 6, Y is a divalent aromatic radical, and $R^1$ is hydrogen or a blocking group.

3. A silver halide photographic element as claimed in claim 1 wherein said amino compound is a compound which (1) comprises at least one secondary or tertiary amino group, (2) contains within its structure a group comprised of at least three repeating ethyleneoxy units, and (3) has a partition coefficient of at least one.

4. A silver halide photographic element as claimed in claim 1 wherein said amino compound is a bis-tertiary amine of the formula:

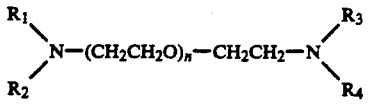

wherein n is an integer with a value of 3 to 50, $R_1$, $R_2$, $R_3$ and $R_4$ are independently alkyl groups of 1 to 8 carbon atoms, $R_1$ and $R_2$ taken together and $R_3$ and $R_4$ taken together represent the atoms necessary to complete a heterocyclic ring.

5. A silver halide photographic element as claimed in claim 1 wherein said amino compound is a bis-secondary amine of the formula:

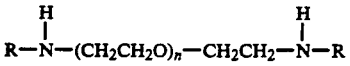

wherein n is an integer with a value of 3 to 50 and each R is independently a linear or branched, substituted or unsubstituted alkyl group of at least 4 carbon atoms.

6. A silver halide photographic element as claimed in claim 1 wherein said isothiourea is represented by the formula:

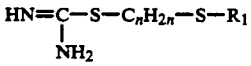

wherein $R_1$ is an alkyl group, a cycloalkyl group, an amino group, a dialkylamino group, an aryl group, an alkaryl group, an aralkyl group or a heterocyclic group, and n is an integer with a value of from 1 to 12.

7. A silver halide photographic element as claimed in claim 1 wherein said isothiourea is represented by the formula:

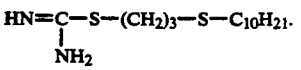

8. A silver halide photographic element as claimed in claim 1 wherein said isothiourea is represented by the formula:

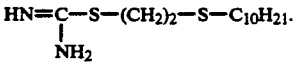

9. A silver halide photographic element as claimed in claim 1 wherein said isothiourea is represented by the formula:

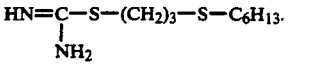

10. A silver halide photographic element as claimed in claim 1 wherein said isothiourea has a partition coefficient of at least one.

11. A silver halide photographic element as claimed in claim 1 wherein said isothiourea has a partition coefficient of at least three.

12. A silver halide photographic element as claimed in claim 1 wherein said isothiourea is represented by the formula:

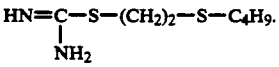

13. A silver halide photographic element as claimed in claim 1 wherein said isothiourea is represented by the formula:

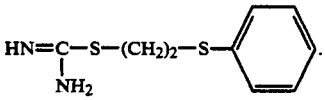

14. A silver halide photographic element as claimed in claim 1 wherein said isothiourea is represented by the formula:

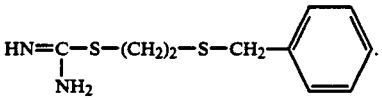

15. A silver halide photographic element as claimed in claim 1 wherein said hydrazine compound is present in an amount of from about 0.1 to about 10 millimoles per mole of silver, said amino compound is present in an amount of from about 1 to about 25 millimoles per mole of silver, and said isothiourea is present in an amount of from about 0.2 to about 5 millimoles per mole of silver.

16. A silver halide photographic element as claimed in claim 1 wherein said silver halide has a mean grain size of about 0.4 microns or less.

17. A silver halide photographic element as claimed in claim 1 wherein said silver halide is silver bromide or silver bromoiodide.

18. A silver halide photographic element as claimed in claim 1 wherein said silver halide is silver chloride, silver chlorobromide or silver chlorobromoiodide.

19. A silver halide photographic element adapted to form a high contrast image when developed with an aqueous alkaline developing solution, said element comprising:

(1) a hydrazine compound that functions as a nucleator, said hydrazine compound having the formula:

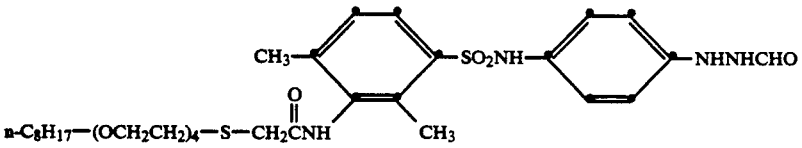

(2) an amino compound that functions as an incorporated booster, said amino compound having the formula:

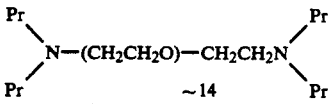

where Pr represents n-propyl, and (3) a ballasted thioether isothiourea that functions as a pepper fog inhibitor and image spread restrainer, said isothiourea having the formula:

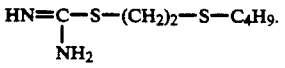

20. A silver halide photographic element adapted to form a high contrast image when developed with an aqueous alkaline developing solution, said element comprising:

(1) a hydrazine compound that functions as a nucleator, said hydrazine compound having the formula:

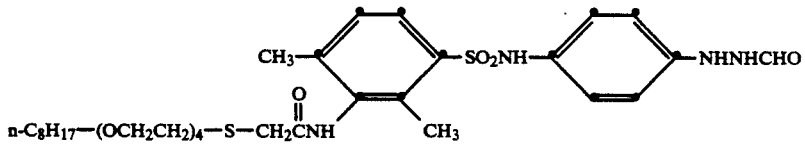

(2) an amino compound that functions as an incorporated booster, said amino compound having the formula:

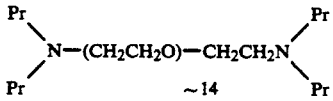

where Pr represents n-propyl, and (3) a ballasted thioether isothiourea that functions as a pepper fog inhibitor and image spread restrainer, said isothiourea having the formula:

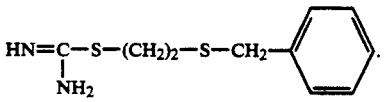

* * * * *